US006352017B1

(12) United States Patent
Ryuh et al.

(10) Patent No.: US 6,352,017 B1
(45) Date of Patent: Mar. 5, 2002

(54) HYDRAULIC PUMP

(75) Inventors: Young-Sun Ryuh; Jong-Cheol Park, both of Ulsan (KR)

(73) Assignee: Samjoo Machinery Co., Ltd. (KR)

( * ) Notice: Subject to any disclaimer, the term of this patent is extended or adjusted under 35 U.S.C. 154(b) by 0 days.

(21) Appl. No.: 09/441,014

(22) Filed: Nov. 16, 1999

(30) Foreign Application Priority Data

Jan. 21, 1999 (KR) ..... 99-759
Aug. 13, 1999 (KR) ..... 99-16680

(51) Int. Cl.[7] ..... F01B 3/00; F16J 1/10
(52) U.S. Cl. ..... 92/71; 92/129
(58) Field of Search ..... 92/12.2, 57, 71, 92/129; 91/499; 417/269; 74/60

(56) References Cited

U.S. PATENT DOCUMENTS 4,620,475 A * 11/1986 Watts ..... 91/499
5,046,403 A * 9/1991 Riedhammer ..... 92/57
5,249,507 A * 10/1993 Kawahara et al. ..... 92/57
5,520,088 A * 5/1996 Dixen ..... 92/71
5,647,266 A * 7/1997 Claas ..... 92/71
5,730,042 A * 3/1998 Engel ..... 92/12.2
5,862,704 A * 1/1999 Seljestad ..... 74/60
5,950,520 A * 9/1999 Kurosawa ..... 92/12.2

FOREIGN PATENT DOCUMENTS

RU 1498938 * 8/1989 ..... 92/71

* cited by examiner

*Primary Examiner*—John E. Ryznic
(74) *Attorney, Agent, or Firm*—Baker Botts LLP

(57) ABSTRACT

A hydraulic pump includes a case having a plurality of fluid paths and a cylinder-shaped groove with a shaft-bearing hole. A shaft is inserted into the shaft-bearing hole of the groove such that the shaft is rotated. A cylinder block is disposed in the groove of the case with a plurality of cylinders such that the cylinder block is rotated upon receipt of a rotational power of the shaft. The cylinder block has a barrel-shaped bottom portion surrounding the shaft. A piston is inserted into each of the cylinders such that the piston reciprocates. A swash plate is combined with the case such that the swash plate covers an opening portion of the groove. The swash plate has an inclined side facing the cylinder block. A shoe has a top side, a bottom side and a stepped middle portion. The top side of the shoe is connected to the piston via a connecting member. The bottom side of the shoe contacts the inclined side of the swash plate. An elastic shoe holder is held between the barrel-shaped bottom portion of the cylinder block and the stepped middle portion of the shoe to compress the shoe against the inclined side of the swash plate.

6 Claims, 7 Drawing Sheets

HYDRAULIC PUMP

BACKGROUND OF THE INVENTION (a) Field of the Invention

The present invention relates to a hydraulic pump and, more particularly, to a hydraulic pump which can perform the function of holding shoes only with one shoe-holding member in an appropriate manner.

(b) Description of the Related Art

Generally, when a hydraulic pump is employed for the high-pressure pumping purpose, it is provided with a swash plate having an inclined side, and a plurality of piston each having a shoe. In order to induce high-pressure pumping operation of such a swash plate-based hydraulic pump in an appropriate manner, the shoe of the piston should tightly contact the inclined side of the swash plate. A sue holding mechanism is usually employed for that purpose.

FIG. 7 is a cross sectional view illustrating a swash plate-based hydraulic pump. The hydraulic pump includes a case 58 having a plurality of fluid paths 52 and 54 and a cylinder-shaped groove 56 with a shaft-bearing hole 57, and a shaft 50 inserted into the shaft-bearing hole 57 of the groove 56 such that it can be rotated. A cylinder block 60 is disposed in the groove 56 of the case 58 such that it can be rotated upon receipt of rotational power of the shaft 50. The cylinder block 60 has a plurality of cylinders 62 each with a passing hole 76 for allowing passage of a fluid between the cylinder 62 and each of the fluid paths 52 and 54. A piston 64 is inserted into the cylinder 62 such that it can reciprocate. A swash plate 68 is combined with the case 58 such that it covers an opening portion of the groove 56. The swash plate 68 has a protruded portion 65 with a top side 66 inclined by a predetermined angle.

A shoe 72 is fixed to the piston 64 via a connecting member 74 and moving along the inclined side 66 of the swash plate 68 with the rotation of the cylinder block 60. The connecting member 74 is formed with a ball joint so that the shoe 72 can freely move along the inclined side of the swash plate 68.

A shoe holder 78 is placed around the shoe 72 to stick it to the swash plate 68. A pair of collars 80 are provided within the cylinder block 60 with a predetermined distance, and an elastic member 82 is tensioned between the collars 80. In order to compress the shoe holder 78 against the shoe 72, a barrel member 86 is disposed between the shaft 50 and the shoe holder 78, and a pin member 84 in turn sticks in between the barrel member 86 and the collar 80 close to the barrel member 86.

In the aforementioned hydraulic pump, the pin member 84 receives elastic force from the elastic member 82 and transmits it to the barrel member 86. The barrel member 86 in turn compresses the shoe holder 78 against the inclined side 66 of the swash plate 68. In this way, the shoe 72 sticks to the inclined side 66 of the swash plate 68 and moves along the inclined side 66 with the rotation of the cylinder block 60. At this time, the piston 64 reciprocates within the cylinder 62 of the cylinder block 60.

In this operation, when the shoe 72 moves downward on the inclined side 66, a fluid is introduced into the cylinder 62 through the fluid-input path 52 via the passing hole 76. In contrast, when the shoe 72 moves upward on the inclined side 66, the fluid introduced into the cylinder 62 is discharged through the fluid-output path 54 via the passing hole 76. In this way, the desired hydraulic pressure can be obtained in the hydraulic pump.

However, in the aforementioned shoe holding mechanism, the plurality of shoe holding components including the collars 80, the elastic member 82, the pin member 84, the barrel member 86 and the shoe holder 78 may cause complicated structure, retarded manufacturing time and increased manufacturing cost, resulting in bad production efficiency. For it can be conceived that some of the shoe holding components are not indispensable for holding the shoes.

SUMMARY OF THE INVENTION

It is an object of the present invention to provide a hydraulic pump which can effectively perform the function of holding a shoe only with one shoe-holding member.

This and other objects may be achieved by a hydraulic pump with an elastic shoe holder. The hydraulic pump includes a case having a plurality of fluid paths and a cylinder-shaped groove with a shaft-bearing hole. A shaft is inserted into the shaft-bearing hole of the groove such that the shaft is rotated. A cylinder block is disposed in the groove of the case with a plurality of cylinders such that the cylinder block is rotated upon receipt of a rotational power of the shaft. The cylinder block has a barrel-shaped bottom portion surrounding the shaft. A piston is inserted into each of the cylinders such that the piston reciprocates. A swash plate is combined with the case such that the swash plate covers an opening portion of the groove. The swash plate has an inclined side facing the cylinder block. A shoe has a top side, a bottom side and a stepped middle portion. The top side of the shoe is connected to the piston via a connecting member. The bottom side of the shoe contacts the inclined side of the swash plate. The elastic shoe holder is held between the barrel-shaped bottom portion of the cylinder block and the stepped middle portion of the shoe to compress the shoe against the inclined side of the swash plate.

The elastic shoe holder includes a base with a center hole and a rounded inner edge defining the center hole. The barrel-shaped bottom portion of the cylinder block surrounding the shaft is partially inserted into the center hole of the base. The rounded inner edge of the base contacts the barrel-shaped bottom portion of the cylinder block. A plurality of shoe-holding parts are branched from the base while spacing apart from each other with a predetermined distance. Each shoe-holding part has upper and lower flat portions arranged parallel to each other and a bent portion interconnecting the upper and lower flat portions. The upper flat portion of the shoe-holding part is extended from the base to the bent portion, and the lower flat portion of the shoe-holding part is extended from the bent portion toward the base. The upper and lower flat portions of the shoe-holding part have holes one by one with a common central axis. The shoe-holding part is inserted onto the stepped middle portion of the shoe through the holes of the upper and lower flat portions.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
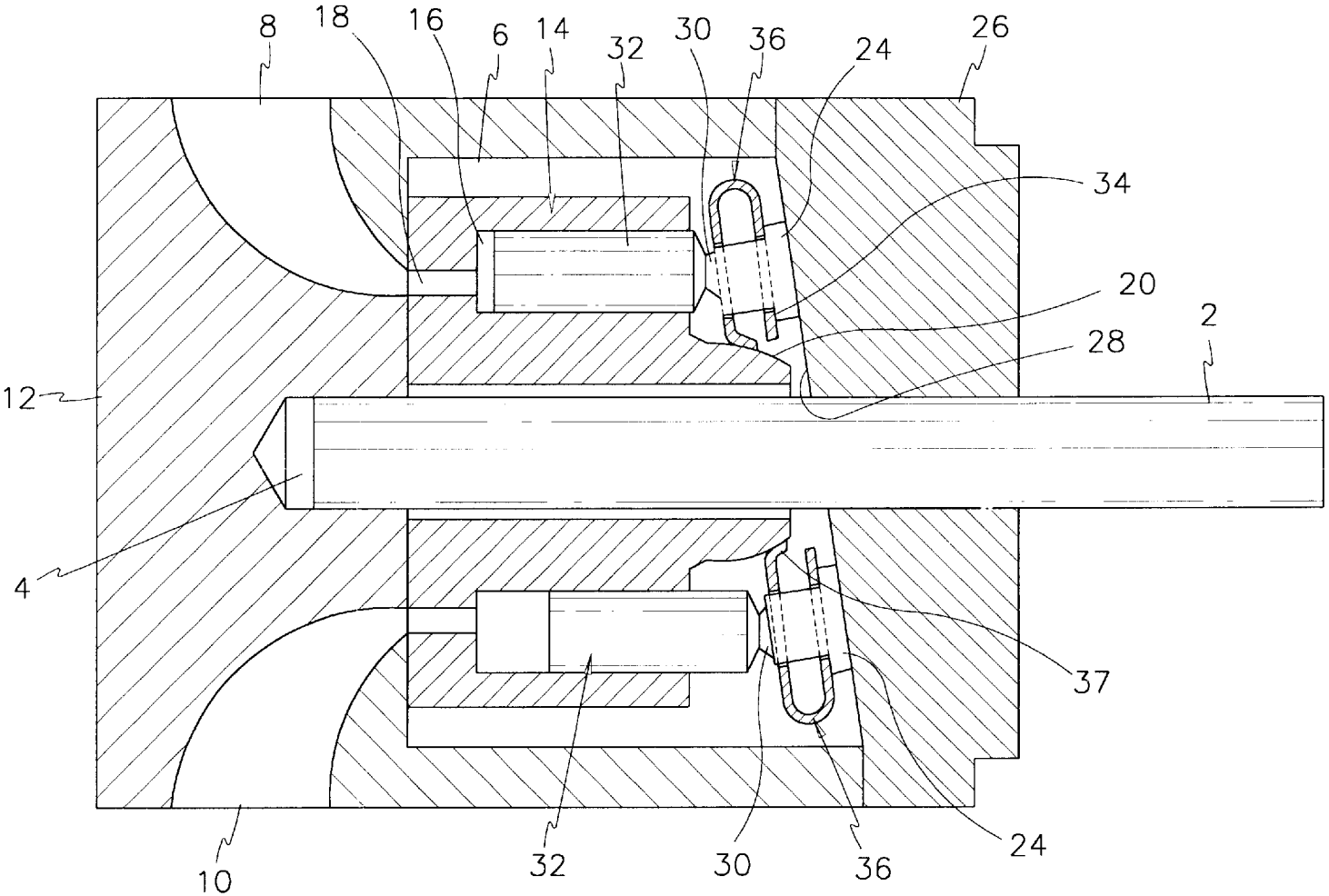
FIG. 1 is a cross sectional view of a hydraulic pump with an elastic shoe holder according to a first preferred embodiment of the present invention.
Figure 2A:
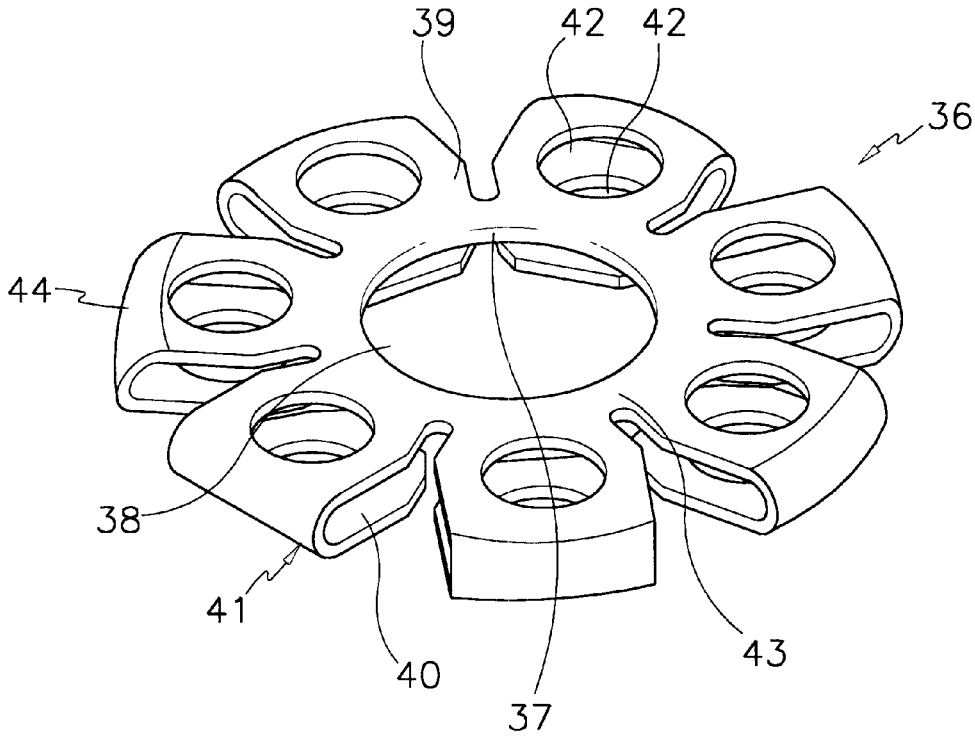
FIG. 2A is a top perspective view of the elastic shoe holder shown in FIG. 1.
Figure 2B:
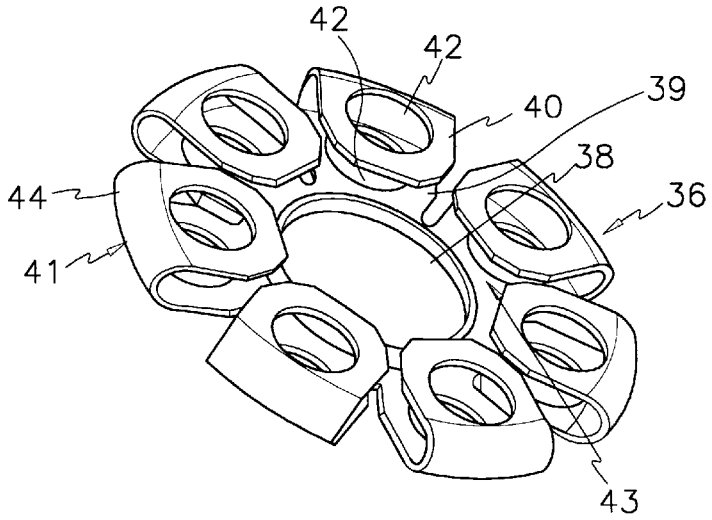
FIG. 2B is a bottom perspective view of the elastic shoe holder shown in FIG. 1.
Figure 2C:
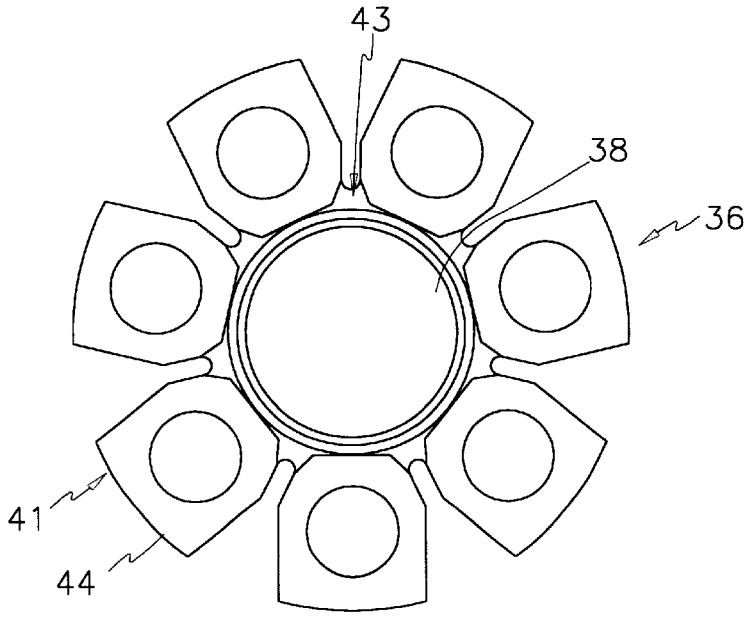
FIG. 2C is a plan view of the elastic shoe holder shown in FIG. 1.
Figure 2D:
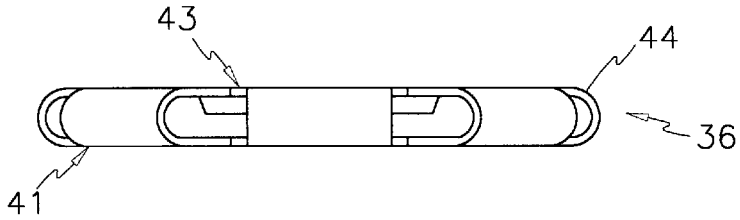
FIG. 2D is a front view of the elastic shoe holder shown in FIG. 1.

FIG. 1 is a cross sectional view of a hydraulic pump with an elastic shoe holder according to a first preferred embodiment of the present invention, and FIGS. 2A to 2C are views specifically illustrating the elastic shoe holder shown in FIG. 1.

As shown in FIG. 1, the hydraulic pump includes a case 12 having a plurality of fluid paths 8 and 10 and a cylinder-shaped groove 6 with a shaft-bearing hole 4, and a shaft 2 inserted into the shaft-bearing hole 4 of the groove 6 such that it can be rotated. A cylinder block 14 is disposed in the groove 6 of the case 12 such that it can be rotated upon receipt of rotational power of the shaft 2. The cylinder block 14 has a plurality of cylinders 16 each with a passing hole 18 for allowing passage of a fluid between the cylinder 16 and each of the fluid paths 8 and 10. A barrel-shaped portion is protruded from a bottom side of the cylinder block 14 in a body while surrounding the shaft 2. The barrel-shaped portion has a rounded side facing a shoe 24, hereinafter referred to simply as a barrel 20. The barrel 20 is to perform the same function as that of the barrel member employed in the conventional hydraulic pump. A piston 32 is inserted into each of the cylinders 16 such that it can reciprocate.

A swash plate 26 is combined with the case 12 such that it covers an opening portion of the groove 6. The swash plate 26 has a top side 28 facing the cylinder block 14 which is inclined by a predetermined angle.

The aforementioned shoe 24 is connected to the piston 32 via a connecting member 30 such that it can move along the inclined side 28 of the swash plate 26 with the rotation of the cylinder block 14. The connecting member 30 is formed with a ball joint for ensuring smooth moving of the shoe 24 along the inclined side 28.

The shoe 24 has a stepped middle portion 34, and an elastic shoe holder 36 is held between the stepped middle portion 34 of the shoe 24 and the barrel 20 of the cylinder block 14.

As shown in FIGS. 2A to 2D, the elastic shoe holder 36 has a base 43 with a center hole 38 into which the barrel 20 of the cylinder block 14 surrounding the shaft 2 is partially inserted, and a plurality of shoe-holding parts 41 branched from the base 43 while spacing apart from each other with a predetermined distance.

The base 43 has a rounded inner edge 37 defining the center hole 38, and the curved inner edge 37 of the base 43 contacts the barrel 20 of the cylinder block 14.

Each of the shoe-holding parts 41 has upper and lower flat portions 39 and 40 arranged parallel to each other, and a bent portion 44 interconnecting the upper and lower flat portions 39 and 40. The upper flat portion 39 of the shoe-holding part 41 is extended from the base 43 to the bent portion 44, and the lower flat portion 40 of the shoe-holding part 41 is extended from the bent portion 44 toward the base 43.

The upper and lower flat portions 39 and 40 of the shoe-holding part 41 are provided with holes 42 one by one which have a common central axis, and the shoe-holding part 41 is inserted onto the stepped middle portion 34 of the shoe 24 through the holes 42 of the upper and lower flat portions 39 and 40.

The elastic force of the elastic shoe holder 36 exerting between the shoe 24 and the barrel 20 makes it possible that the shoe 24 tightly contacts the inclined side 28 of the swash plate 26 and moves along the inclined side 28 with the rotation of the cylinder block 14 in a stable manner.

In operation, as the shaft 2 transmits a rotational force to the cylinder block 14, the shoe 24 connected to the piston 32 via the connecting member 30 moves along the inclined side 28 of the swash plate 26 so that the piston 32 reciprocates within the cylinder 16 of the cylinder block 14. In case the shoe 24 moves downward on the inclined side 28, a fluid is introduced into the cylinder 16 through the fluid-input path 8 via the passing hole 18. In contrast, when the shoe 24 moves upward on the inclined side 28, the fluid introduced into the cylinder 16 is discharged through the fluid-output path 10 via the passing hole 18.

In the following preferred embodiments, the overall components of the hydraulic pump will be the same as those related to the first preferred embodiment except that the elastic shoe holder has a different structure.

Figure 3A:
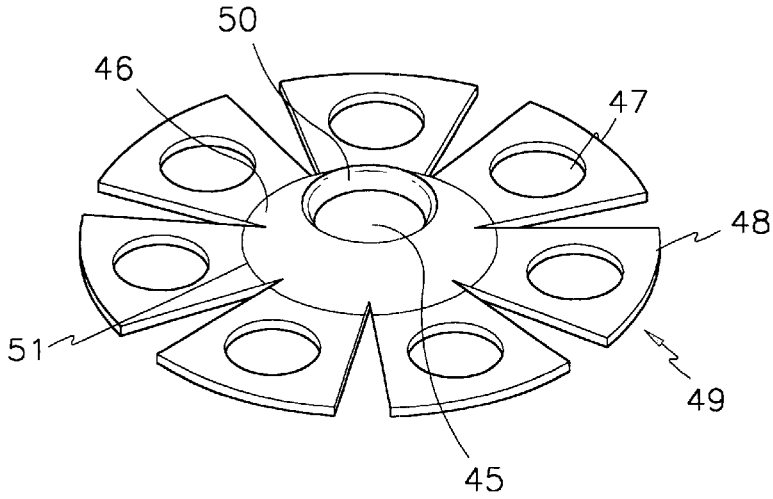
FIG. 3A is a perspective view of an elastic shoe holder for a hydraulic pump according to a second preferred embodiment of the present invention.
Figure 3B:
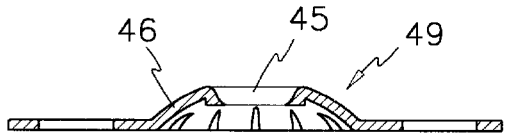
FIG. 3B is a front view of the elastic shoe holder shown in FIG. 3A.
Figure 3C:
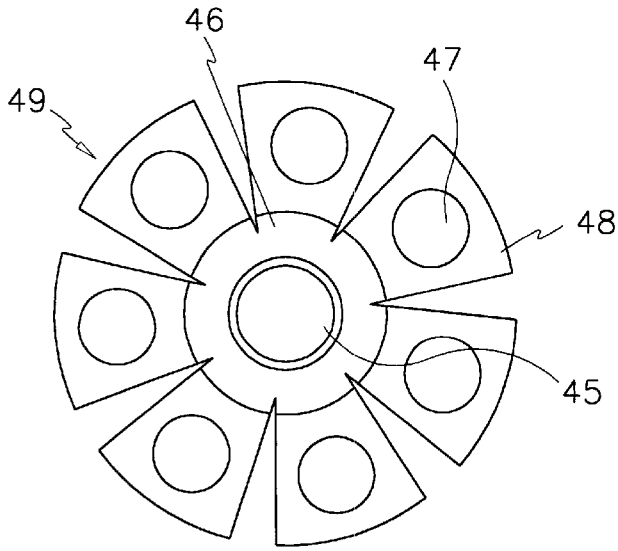
FIG. 3C is a plan view of the elastic shoe holder shown in FIG. 3A.

FIGS. 3A to 3C are views illustrating an elastic shoe holder for a hydraulic pump according to a second preferred embodiment of the present invention.

As shown in FIGS. 3A to 3C, the elastic shoe holder 49 has a dish-shaped base 46 facing down with a center hole 45 into which the barrel 20 of the cylinder block 14 surrounding the shaft 2 is partially inserted. In this structure, it naturally follows that a narrow inner edge 50 of the base 46 defining the center hole 45 is placed in a plane higher than a wide outer edge 51 of the base 46. The narrow inner edge 50 of the base 46 is rounded and smoothly contacts the barrel 20 of the cylinder block 14.

A plurality of shoe-holding parts 48 are branched from the wide outer edge of the base 46 while spacing apart from each other with a predetermined distance. The shoe-holding parts 48 are flat-shaped each with a hole 47. The shoe-holding part 48 is inserted onto the stepped middle portion 34 of the shoe 24 through the hole 47.

In operation, the elastic force of the above-structured elastic shoe holder 49 exerting between the shoe 24 and the barrel 20 makes it possible that the shoe 24 tightly contacts the inclined side 28 of the swash plate 26 and moves along the inclined side 28 with the rotation of the cylinder block 14 in a stable manner.

Figure 4A:
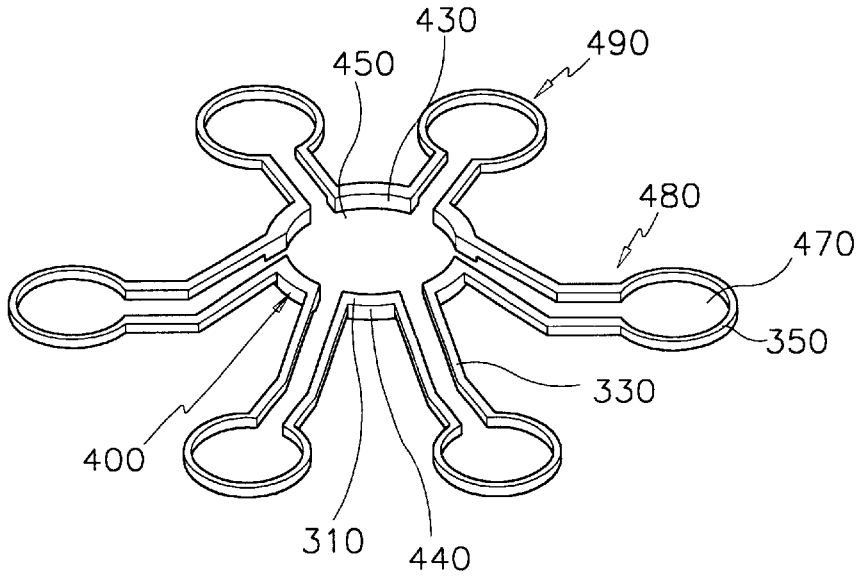
FIG. 4A is a perspective view of an elastic shoe holder for a hydraulic pump according to a third preferred embodiment of the present invention.
Figure 4B:
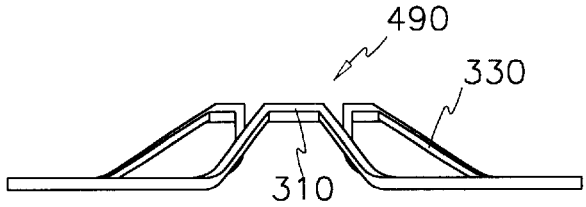
FIG. 4B is a front view of the elastic shoe holder shown in FIG. 4A.
Figure 4C:
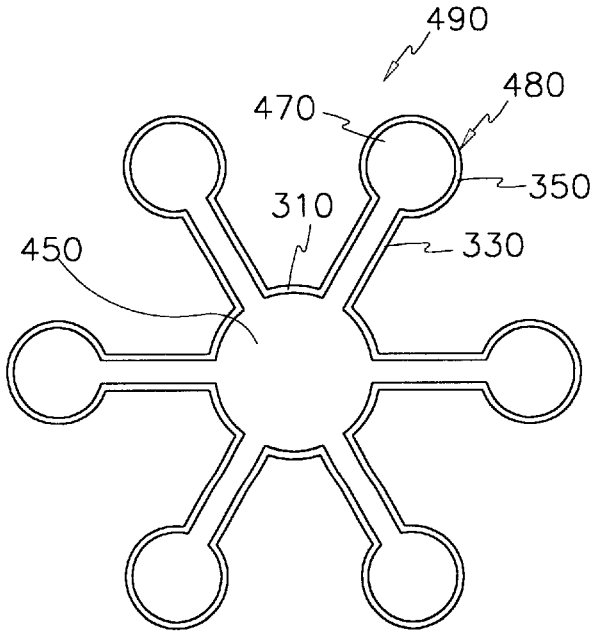
FIG. 4C is a plan view of the elastic shoe holder shown in FIG. 4A.

FIGS. 4A to 4C are views illustrating an elastic shoe holder for a hydraulic pump according to a third preferred embodiment of the present invention. In this preferred embodiment, the elastic shoe holder 490 is formed with a strip-shaped material whose sectional shape may be a polygon or a circle.

As shown in FIG. 4A, the elastic shoe holder 490 has a roughly hoop-shaped base 400 outlined with a plurality of disconnected portions 310 about a center hole 450. The barrel 20 of the cylinder block 14 is partially inserted into the center hole 450. The disconnected portion 310 of the base 400 has an inner narrow edge 430 defining the center hole 450 and an outer wide edge 440. The inner narrow edge 430 of the disconnected portion 310 is rounded and smoothly contacts the barrel 20.

A plurality of shoe-holding parts 480 are branched from the base 400 at the outer wide edges 440 of the disconnected portions 310 while spacing apart from each other with a predetermined distance. The shoe-holding part 480 has an open-ended rounding portion 350 about a hole 470, and a double-lined portion 330 interconnecting the free ends of the open-ended rounding portion 350 and the corresponding free ends of the neighboring disconnected portions 310 close to each other. The shoe-holding part 480 is inserted onto the stepped middle portion 34 of the shoe 24 through the hole 470 of the shoe-holding part 480. In order to exert sufficient elastic force between the barrel 20 of the cylinder block 14 and the shoe 24, the double-lined portion 330 of the shoe-holding part 480 is structured to have a bent or curved shape. In this structure, the base 400 of the elastic shoe holder 490 is placed in a plane higher than the shoe-holding part 480.

Figure 5A:
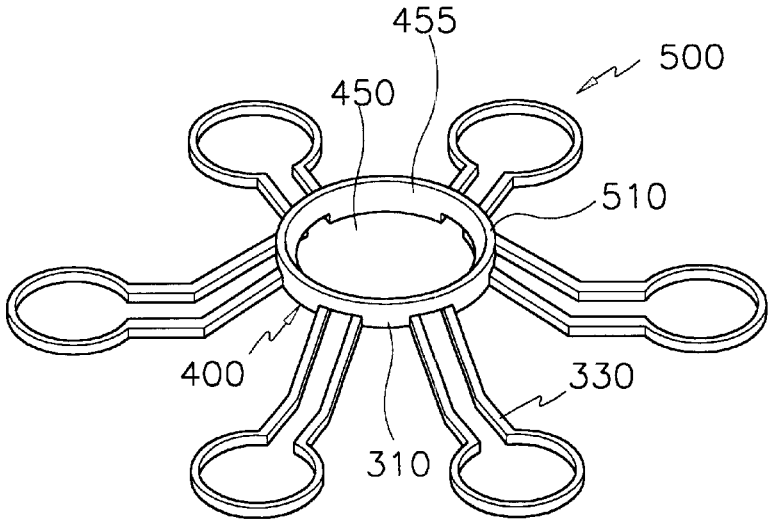
FIG. 5A is a perspective view of an elastic shoe holder for a hydraulic pump according to a fourth preferred embodiment of the present invention.
Figure 5B:
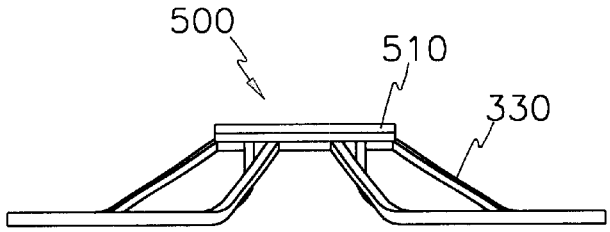
FIG. 5B is a front view of the elastic shoe holder shown in FIG. 5A.

FIGS. 5A and 5B are views illustrating an elastic shoe holder for a hydraulic pump according to a fourth preferred embodiment of the present invention.

In this preferred embodiment, the overall structure of the elastic shoe holder 500 is the same as that related to the third preferred embodiment except that a ring 510 with a rounded inner edge 455 is mounted around the base 400 to interconnect all of the disconnected portions 310 of the base 400, and the rounded inner edge 455 of the ring 510 contacts the barrel 20. The ring 510 is to enhance the overall elasticity, durability and intensity of the elastic shoe holder 500.

Figure 6:
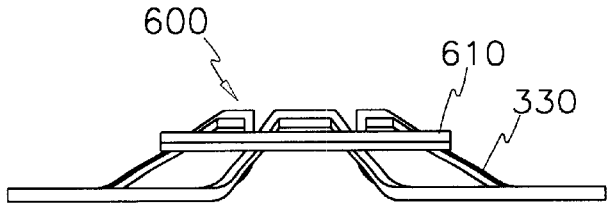
FIG. 6 is a front view of an elastic shoe holder for a hydraulic pump according to a fifth preferred embodiment of the present invention.
Figure 7:
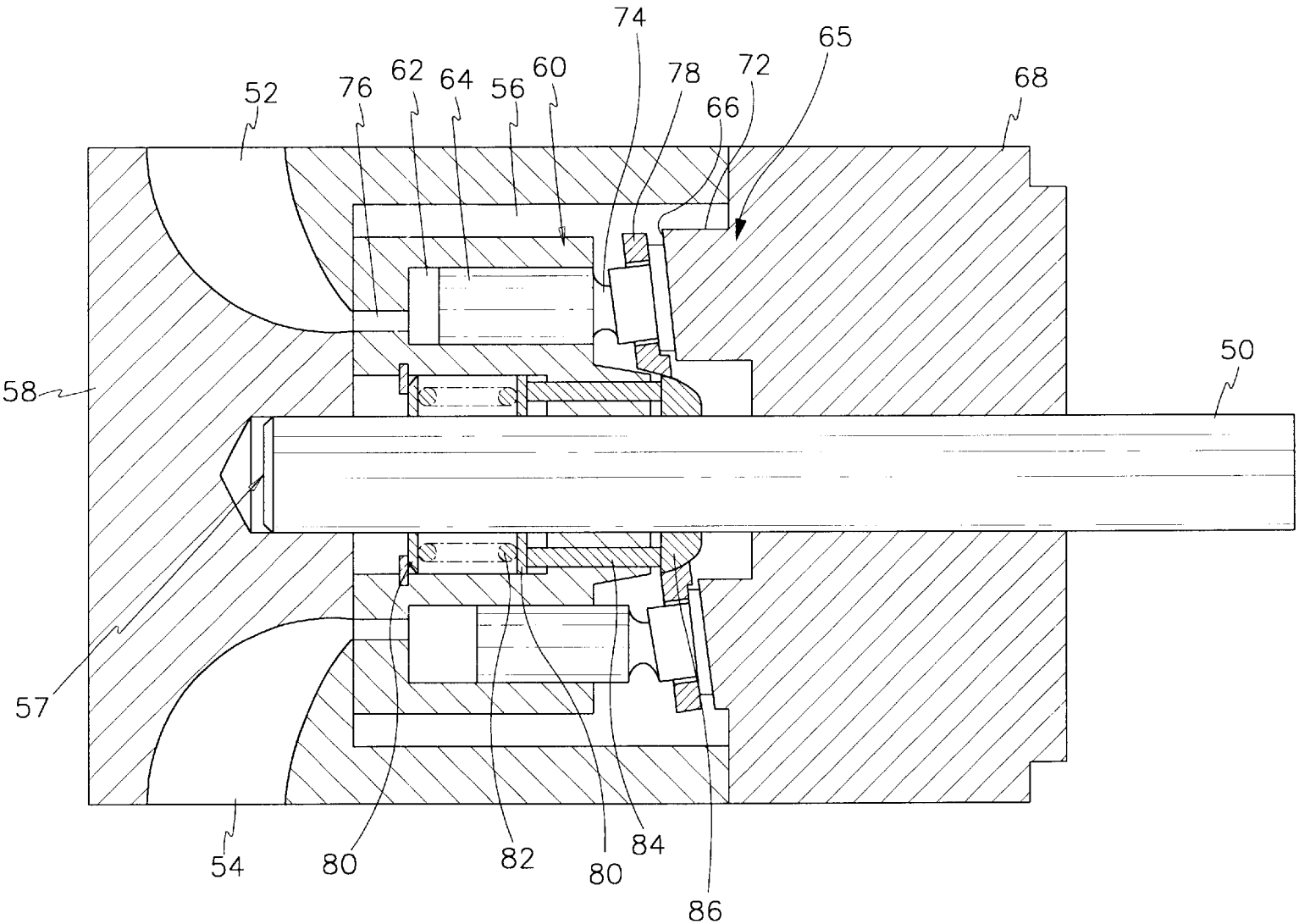
FIG.7 (Prior Art)
FIG. 7 is a cross sectional view of a hydraulic pump according to a prior art.

FIG. 6 is a front view of an elastic shoe holder for a hydraulic pump according to a fifth preferred embodiment of the present invention.

In this preferred embodiment, the overall structure of the elastic shoe holder 600 is the same as that related to the third preferred embodiment except that a ring 610 is mounted around the double-lined portions 330 of the shoe-holding part 480 to interconnect the double-lined portions 330. In this structure, the elasticity, durability and intensity of the elastic shoe holder 600 can be controlled by changing the position of the ring 610 on the double-lined portions 330.

As described above, the inventive hydraulic pump can perform the function of holding shoes only with one elastic shoe holder in a stable manner. This results in reduced manufacturing time, economical manufacturing cost and good production efficiency.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A hydraulic pump comprising:

a case having a plurality of fluid paths and a cylinder-shaped groove with a shaft-bearing hole;

a shaft received in the shaft-bearing hole of the groove such that the shaft is rotatable;

a cylinder block disposed in the groove of the case and having a plurality of cylinders, the cylinder block being rotated upon receipt of a rotational power of the shaft and the cylinder block having a barrel-shaped bottom portion surrounding the shaft;

a piston received in each of the cylinders for reciprocating movement therein;

a swash plate associated with the case such that the swash plate covers an opening portion of the groove, the swash plate having an inclined surface facing the cylinder block;

a shoe associated with each piston, each shoe having a top side, a bottom side and a stepped middle portion, the top side of each shoe being connected to the piston via a connecting member and the bottom side of the shoe contacting the inclined side of the swash plate; and an elastic shoe holder having a base with a center hole through which the shaft extends and engaging the barrel-shaped bottom portion of the cylinder block and a plurality of separate shoe-holding parts, one for each shoe that are branched from the base while being spaced apart from each other with a predetermined distance for each shoe, each shoe holding part engaging the stepped middle portion of the shoe and biasing the shoe against the inclined side of the swash plate.

2. The hydraulic pump of claim 1, wherein the base of the elastic shoe holder is substantially hoop-shaped with the center hole having a rounded inner edge; wherein the barrel-shaped bottom portion of the cylinder block surrounding the shaft is received in the center hole of the base with the curved inner edge of the base contacting the barrel-shaped bottom portion of the cylinder block; and wherein the shoe-holding parts are spaced apart from each other at a predetermined distance, each shoe-holding part having upper and lower flat portions arranged parallel to each other and a bent portion interconnecting the upper and lower flat portions, the upper flat portion of the shoe-holding part extending from the base to the bent portion and the lower flat portion of the shoe-holding part extending from the bent portion toward the base, the upper and lower flat portions of the shoe-holding part having holes with a common central axis, the shoe-holding part being received on the stepped middle portion of the shoe through the holes of the upper and lower flat portions.

3. The hydraulic pump of claim 1, wherein the base of the elastic shoe holder is substantially dish-shaped and slopes toward the center hole, the barrel-shaped bottom portion of the cylinder block surrounding the shaft being received in the center hole of the base, the base having a narrow inner edge defining the center hole and a wide outer edge located in a plane lower than the narrow inner edge, the narrow inner edge of the base being rounded and contacting the barrel-shaped bottom portion of the cylinder block; and wherein the shoe-holding parts branch out from the wide outer edge of the base and are spaced apart from each other at a predetermined distance, each shoe-holding part being flat and having a hole, and the hole in each shoe-holding part receiving the stepped middle portion of the shoe.

4. The hydraulic pump of claim 1, wherein the base of the shoe-holding part is substantially hoop-shaped and is formed with a plurality of disconnected portions about a center hole, the barrel-shaped bottom portion of the cylinder block surrounding the shaft being received in the center hole of the base, each disconnected portion of the base having an inner narrow edge defining the center hole and an outer wide edge, the inner narrow edge of the disconnected portions being rounded and contacting the barrel-shaped bottom portion of the cylinder block; and the shoe-holding parts extending from the base at the outer wide edges of the disconnected portions and being spaced apart from each other at a predetermined distance, each shoe-holding part having an open-ended rounded portion about a hole and a double-lined portion interconnecting free ends of the open-ended rounding portion and free ends of the adjacent disconnected portions close to each other, the shoe-holding part being inserted onto the stepped middle portion of the shoe through the hole, the double-lined portion being bent or curved such that the base is placed in a plane higher than the shoe-holding part.

5. The hydraulic pump of claim 4, wherein the elastic shoe holder further comprises a ring with a rounded inner edge, the ring being mounted around the base to interconnect the disconnected portions of the base, the rounded inner edge of the ring contacting the barrel-shaped bottom portion of the cylinder block, the ring enhancing elasticity, durability and intensity of the elastic shoe holder.

6. The hydraulic pump of claim 4, wherein the elastic shoe holder further comprises a ring mounted around the double-lined portions of the shoe-holding part to interconnect the double-lined portions, thereby enhancing elasticity, durability and intensity of the elastic shoe holder.

* * * * *

UNITED STATES PATENT AND TRADEMARK OFFICE

CERTIFICATE OF CORRECTION

PATENT NO. : 6,352,017 B1
DATED : March 5, 2002
INVENTOR(S) : Ryuh et al.

It is certified that error appears in the above-identified patent and that said Letters Patent is hereby corrected as shown below:

Column 1,
Line 13, “piston” should read -- pistons --
Line 17, “sue” should read -- shoe --
Line 19, “cross sectional” should read -- cross-sectional --

Column 2,
Line 51, “one by one” should read -- respectively --
Line 65, “cross sectional” should read -- cross-sectional --

Column 3
Lines 32 and 39, “cross sectional” should read -- cross-sectional --

Column 4,
Line 26, “one by one” should read -- respectively --

Column 6,
Line 34, “shoe” should read -- shoe, --

Signed and Sealed this

Twenty-first Day of January, 2003

JAMES E. ROGAN
*Director of the United States Patent and Trademark Office*